US010709172B2

(12) United States Patent
Jiang et al.

(10) Patent No.: US 10,709,172 B2
(45) Date of Patent: Jul. 14, 2020

(54) ELECTRONIC CIGARETTE AND ATOMIZER THEREOF

(71) Applicant: Shenzhen First Union Technology Co., Ltd., Shenzhen, Guangdong Province (CN)

(72) Inventors: Pengfei Jiang, Shenzhen (CN); Yindeng Deng, Shenzhen (CN); Zhongli Xu, Shenzhen (CN); Yonghai Li, Shenzhen (CN)

(73) Assignee: Shenzhen First Union Technology Co., Ltd., Shenzhen, Guangdong (CN)

( * ) Notice: Subject to any disclaimer, the term of this patent is extended or adjusted under 35 U.S.C. 154(b) by 354 days.

(21) Appl. No.: 15/873,916

(22) Filed: Jan. 18, 2018

(65) Prior Publication Data

US 2018/0206554 A1 Jul. 26, 2018

(30) Foreign Application Priority Data

Jan. 20, 2017 (CN) ..... 2017 2 0082908 U

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | | |
|---|---|---|---|---|
| 9,795,170 | B1 * | 10/2017 | Zhu | F16K 3/0281 |
| 2016/0007654 | A1 | 1/2016 | Zhu | |
| 2017/0119055 | A1 * | 5/2017 | Liu | A24F 47/008 |
| 2017/0281883 | A1 * | 10/2017 | Li | A61M 15/0001 |
| 2018/0049470 | A1 * | 2/2018 | Chen | A24F 47/008 |
| 2019/0274356 | A1 * | 9/2019 | Deng | A24F 47/008 |
| 2019/0307168 | A1 * | 10/2019 | Zhao | A24F 40/40 |

FOREIGN PATENT DOCUMENTS

| | | | |
|---|---|---|---|
| EP | 3 020 292 | A1 | 5/2016 |
| WO | 2015/078011 | A1 | 6/2015 |

* cited by examiner

*Primary Examiner* — James Harvey
(74) *Attorney, Agent, or Firm* — Proi Intellectual Property US; Klaus Michael Schmid

(57) ABSTRACT

An electronic cigarette and an atomizer are disclosed, the atomizer includes a reservoir, the reservoir being configured for storing tobacco liquid; an atomizing assembly, the atomizing assembly being disposed inside the reservoir, at a lower end of the reservoir, and configured to absorb tobacco liquid for atomization; and a blocking component, the blocking component being disposed in the reservoir, and configured for blocking tobacco liquid in the reservoir when tobacco liquid flows from the lower end of the reservoir toward an upper end thereof, such that tobacco liquid is kept around the atomizing assembly, and hence avoiding few tobacco liquid existing in the atomizing assembly because of rapid flowing of the tobacco liquid such that the electronic cigarette may generate burnt flavor when smoked.

18 Claims, 4 Drawing Sheets

ELECTRONIC CIGARETTE AND ATOMIZER THEREOF

CROSS REFERENCE TO RELATED APPLICATIONS

The present application claims priority to Chinese patent application CN 201720082908.0 filed on Jan. 20, 2017.

TECHNICAL FIELD

The present disclosure relates to the field of electronic cigarettes, and in particular, to an electronic cigarette capable of avoiding burnt flavor during being smoked and an atomizer thereof.

BACKGROUND ART

An electronic cigarette and an atomizer thereof known to the inventors, tobacco liquid in a tobacco liquid reservoir of the atomizer directly contacts with a liquid conducting component, thus when the electronic cigarette is laid flat or tilted with a tail upwards to be smoked, tobacco liquid flows toward the mouthpiece quickly and there is less tobacco liquid remaining in the atomizing assembly, which may be quickly consumed to generate peculiar smell, burnt flavor etc., diminishing the user experience.

SUMMARY

The present disclosure is related to an electronic cigarette and an atomizer thereof to solve the problem that when the electronic cigarette is laid flat or tilted with a tail upwards to be smoked, because the atomizing assembly lacks of tobacco liquid, the electronic cigarette may generate peculiar smell, burnt flavor etc.

To overcome the above drawbacks, according to an embodiment, an atomizer is disclosed including a reservoir, an atomizing assembly and a blocking component; the reservoir is configured for storing tobacco liquid; the atomizing assembly is disposed inside the reservoir, at a lower end of the reservoir, and configured to absorb tobacco liquid for atomization; the blocking component is disposed in the reservoir, and configured for blocking tobacco liquid in the reservoir when tobacco liquid flowing from the lower end of the reservoir toward an upper end thereof, such that tobacco liquid is kept around the atomizing assembly.

According to embodiments of the present disclosure, the atomizer further includes a gas tube and a mouthpiece; the mouthpiece is disposed at the upper end of the reservoir; the gas tube is configured for communicating the atomizing assembly and the mouthpiece; the blocking component includes a blocking ring fixed on the gas tube; an outer surface of the blocking ring abuts against an inner surface of the reservoir.

According to embodiments of the present disclosure, the blocking ring is fixed on a joint of the gas tube and the atomizing assembly; a vent disposed on the blocking ring is configured for communicating the gas tube and the atomizing assembly.

According to embodiments of the present disclosure, the blocking component further includes a first insert tube and a second insert tube at two sides of the blocking ring; the first insert tube is inserted into a lower end of the gas tube for fixing and the second insert tube is inserted into an upper end of the atomizing assembly for fixing; the vent is also configured to be in communication with the first insert tube and the second insert tube.

According to embodiments of the present disclosure, the blocking ring further has a hole formed thereon, configured for allowing tobacco liquid passing through the hole to flow in the reservoir.

According to embodiments of the present disclosure, the hole is a cutout hole formed on edge of the blocking ring.

According to embodiments of the present disclosure, the atomizing assembly includes an atomizing sleeve, a liquid conducting component and a heating element; the atomizing sleeve has a liquid conducting hole formed thereon; the liquid conducting component is disposed inside the atomizing sleeve to absorb tobacco liquid by means of the liquid hole; the heating element is disposed inside the liquid conducting component to heat and atomize tobacco liquid absorbed by the liquid conducting component.

According to embodiments of the present disclosure, the atomizer further includes a base connected with the lower end of the reservoir, configured for connecting battery modules so as to supply power to the heating element, in which, the base includes a cathode base, an insulating bush and anode rods; the anode rods are interval inserted into the cathode base through the insulating bush, insulated from the cathode base; two pins of the heating element are respectively in contact with the cathode base and the anode rods to form a conductance.

According to embodiments of the present disclosure, the blocking ring is disposed on the gas tube.

To overcome the above drawbacks, an electronic cigarette is further disclosed by the present disclosure, the electronic cigarette includes a battery module and an atomizer, in which the atomizer includes: a reservoir, the reservoir being configured for storing tobacco liquid; an atomizing assembly, the atomizing assembly being disposed inside the reservoir, at a lower end of the reservoir, and configured to absorb tobacco liquid for atomization; and a blocking component, the blocking component being disposed in the reservoir, and configured for blocking tobacco liquid in the reservoir when tobacco liquid flows toward an upper end of the reservoir, such that tobacco liquid is kept around the atomizing assembly.

According to embodiments of the present disclosure, the atomizer further includes a gas tube and a mouthpiece; the mouthpiece is disposed at the upper end of the reservoir; the gas tube is configured for communicating the atomizing assembly and the mouthpiece; the blocking component includes a blocking ring fixed on the gas tube; an outer surface of the blocking ring abuts against an inner surface of the reservoir.

According to embodiments of the present disclosure, the blocking ring is fixed on a joint of the gas tube and the atomizing assembly; a vent disposed on the blocking ring is configured for communicating the gas tube and the atomizing assembly.

According to embodiments of the present disclosure, the blocking component further includes a first insert tube and a second insert tube at two sides of the blocking ring; the first insert tube is inserted into a lower end of the gas tube for fixing and the second insert tube is inserted into an upper end of the atomizing assembly for fixing; the vent is also configured to be in communication with the first insert tube and the second insert tube.

According to embodiments of the present disclosure, the blocking ring further has a hole formed thereon, configured for allowing tobacco liquid passing through the hole to flow in the reservoir.

According to embodiments of the present disclosure, the hole is a cutout hole formed on edge of the blocking ring.

According to embodiments of the present disclosure, the atomizing assembly includes an atomizing sleeve, a liquid conducting component and a heating element; the atomizing sleeve has a liquid conducting hole formed thereon; the liquid conducting component is disposed inside the atomizing sleeve to absorb tobacco liquid by means of the liquid hole; the heating element is disposed inside the liquid conducting component to heat and atomize tobacco liquid absorbed by the liquid conducting component.

According to embodiments of the present disclosure, the atomizer further includes a base connected with the lower end of the reservoir, the base being configured for connecting battery modules to supply power to the heating element; the base includes a cathode base, an insulating bush and anode rods; the anode rods are interval inserted into the cathode base through the insulating bush, insulated from the cathode base; two pins of the heating element are respectively in contact with the cathode base and the anode rods to form a conductance.

According to embodiments of the present disclosure, the cathode base and the atomizing sleeve are formed integrally or are two separate structures; the cathode base has a threaded jointer convexly disposed thereon; the threaded jointer is configured for connecting the battery modules; the cathode base has a first inlet airway formed thereon and the anode rods has a second inlet airway formed thereon.

According to embodiments of the present disclosure, the blocking ring is disposed on the gas tube.

Compared to the existing technologies known to the inventors, the electronic cigarette and the atomizer thereof have a blocking component disposed thereon, the blocking component is capable of blocking rapid flowing of the tobacco liquid when the reservoir is laid flat or tilted with a tail upwards, ensuring the tobacco liquid to be kept around the atomizing assembly, and hence avoiding few tobacco liquid existing in the atomizing assembly because of rapid flowing of the tobacco liquid such that the electronic cigarette may generate burnt flavor when smoked.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
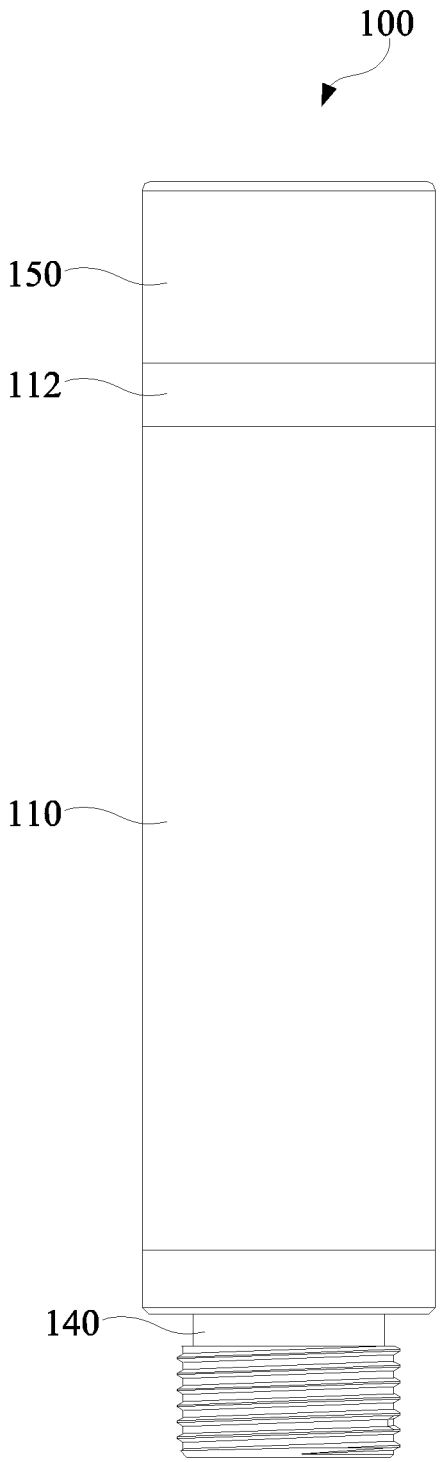
FIG. 1 is a lateral perspective view of an atomizer according to a first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
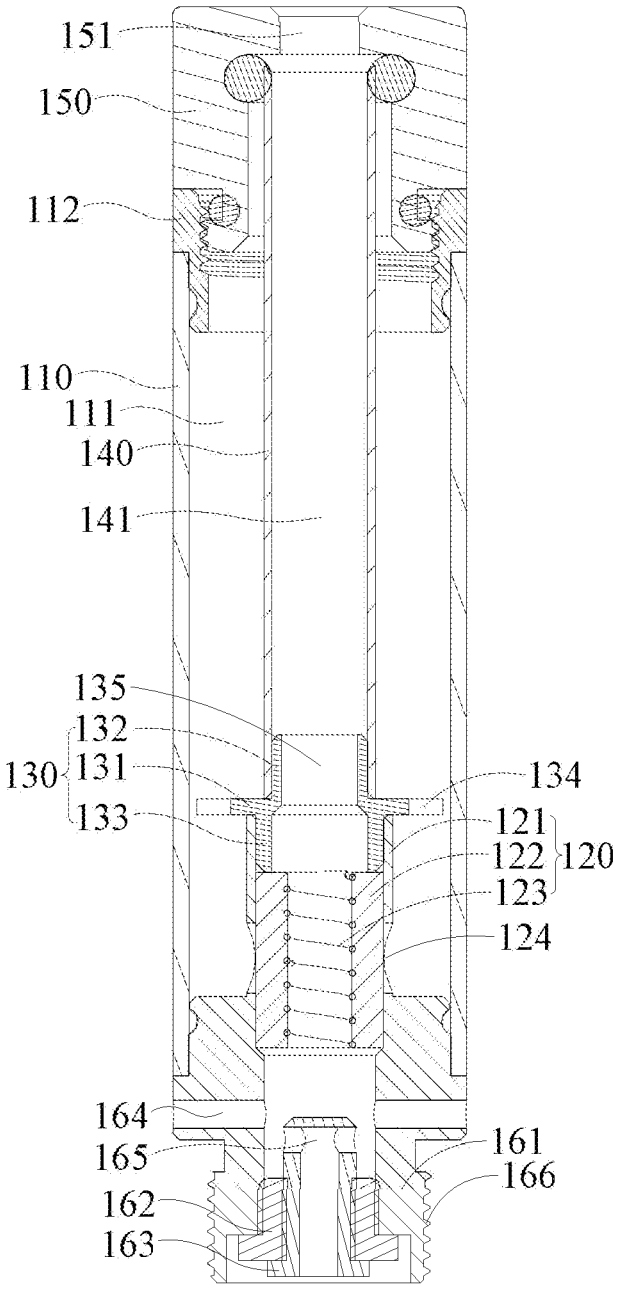
FIG. 2 is a cross-sectional view of the atomizer of FIG. 1.
Figure 3:
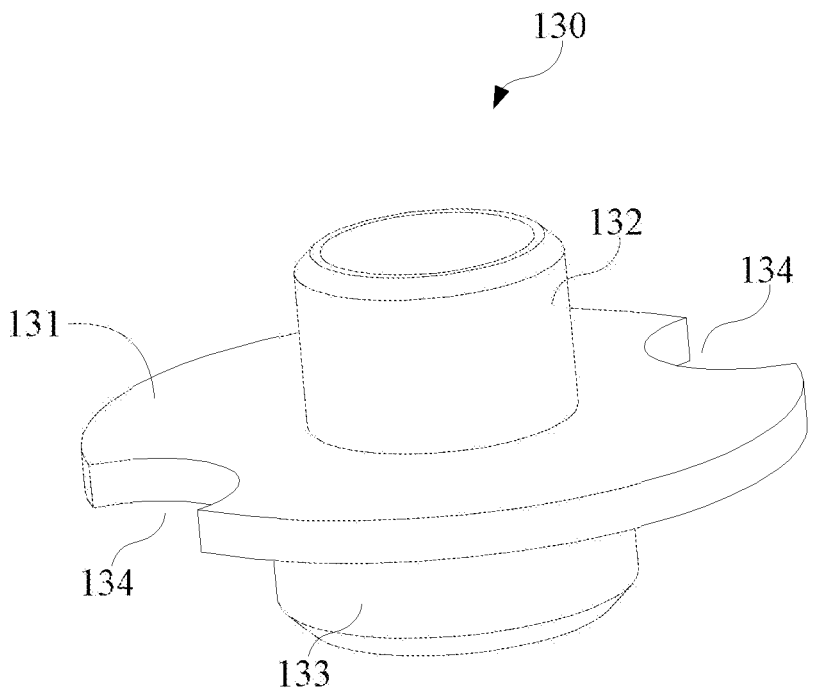
FIG. 3 is an aspect view of a blocking component incorporated by the atomizer of FIG. 2.

Referring to FIG. 1 to FIG. 3, the present disclosure is related to an atomizer 100 including a reservoir 110, an atomizing assembly 120 and a blocking component 130.

The reservoir 100 is configured for storing tobacco liquid, generally it is a glass container, convenient for checking a tobacco liquid residue in the reservoir 110. Or, the reservoir 110 includes an outer metallic container and inner glass container, the outer metallic container has a long-striped opening. The outer metallic container is capable of protecting the inner glass container, but also checking the tobacco liquid residual from the long-striped opening.

The atomizing assembly 120 is disposed inside the reservoir 110, at a lower end thereof, and configured for absorbing tobacco liquid for atomization.

The blocking component 130 is disposed inside the reservoir 110, and configured for blocking tobacco liquid in the reservoir 110 when tobacco liquid flowing from the lower end of the reservoir 110 toward an upper end of the reservoir 110, such that tobacco liquid is kept around the atomizing assembly 120.

More specifically, the atomizer 100 further includes a gas tube 140 and a mouthpiece 150.

In which, the gas tube 140 has a central airway 141, an outer surface of the gas tube 140 and the inner wall of the reservoir 110 form a liquid storage chamber 111 configured for storing tobacco liquid.

The mouthpiece 150 is disposed at the upper end of the reservoir 110 through a fixing tube. The mouthpiece 150 has an air suction port 151; the gas tube 140 is configured for communicating the atomizing assembly 120 and the mouthpiece 150, allowing the aerosol generated by the atomizing assembly 120 to be outputted to the user's mouth through the central airway 141 and the air suction port 151.

The material of the blocking component 130 may be metallic or plastic. The blocking component 130 includes a blocking ring 131 fixed on the gas tube 140; an outer surface of the blocking ring 131 abuts against an inner surface of the reservoir 110. The blocking ring 131 divided the reservoir 110 into an upper chamber and a lower chamber. The blocking ring 131 is capable of preventing rapid flowing of tobacco liquid between the upper chamber and lower chamber.

In present embodiment, the blocking ring 131 is fixed on a joint of the gas tube 140 and the atomizing assembly 120; a vent 135 is disposed on the blocking ring 131, the vent 135 is configured for communicating the gas tube 140 and the atomizing assembly 120.

In some embodiments, the blocking ring 131 may be fixed on the gas tube 140 directly.

With reference to FIG. 2 and FIG. 3, the blocking component 130 further includes a first insert tube 132 and a second insert tube 133 at two sides of the blocking ring 131; the first insert tube 132 is inserted into a lower end of the gas tube 140 for fixing and the second insert tube 133 is inserted into an upper end of the atomizing assembly 120 for fixing; the vent 135 is configured to be in communication with the first insert tube 132 and the second insert tube 133.

The blocking ring 131 further has a hole 134 formed thereon, configured for allowing tobacco liquid passing through the hole 134 to flow in the reservoir 110.

According to embodiments of the present disclosure, the hole 134 is a cutout hole defined on the edge of the blocking ring 131. Of course, the specific structure of the hole 134 is not only limited herein. In some embodiments, the hole 134 may be multiple small pores formed on the blocking ring 131, since the tobacco liquid is mostly comparatively sticky, it is really slow when tobacco liquid is passing though the small pore having a small pore size. Apparently, small pores set on the blocking ring 131 are capable of slowing down the rapid flowing of tobacco liquid, and hence avoiding the atomizing assembly 120 generates burnt flavor because of the rapid flowing of tobacco liquid when the electronic cigarette 200 is laid flat or tilted.

In the present embodiment, the atomizing assembly 120 includes an atomizing sleeve 121, a liquid conducting component 122 and a heating element 123; the atomizing sleeve 121 has a liquid conducting hole 124 formed thereon; the liquid conducting component 122 is disposed inside the atomizing sleeve 121 absorbs tobacco liquid through the liquid hole 124; the heating element 123 is disposed inside the liquid conducting component 122, and configured for heating and atomizing tobacco liquid absorbed by the liquid conducting component 122.

In which, the atomizing sleeve 121 may be made by brass or some other materials. Any number and any shape of the liquid conducting hole 126 may be available to only allow that the liquid conducting component 122 absorbs tobacco liquid.

The atomizer 100 further includes a base 160 connected with the lower end of the reservoir 110, configured for connecting battery modules so as to supply power to the heating element 123, the base includes a cathode base 161, an insulating bush 162 and anode rods 163; the anode rods 163 are interval inserted into the cathode base 161 through the insulating bush 162, insulating from the cathode base 161; two pins (not shown) of the heating element 123 are respectively in contact with the cathode base 161 and the anode rods 163 to form a conductance.

In the present embodiment, the cathode base 161 and the atomizing sleeve 121 may be formed integrally; in some embodiments, the cathode base 161 and the atomizing sleeve 121 are two separate structures.

Moreover, the cathode base 161 has a threaded jointer 166 convexly disposed thereon. The threaded jointer 166 is configured for connecting the battery module 210. Furthermore, the cathode base 161 has a first inlet airway 164 formed thereon and the anode rods 163 has a second inlet airway 165 formed thereon. When a user inhales aerosol through the mouthpiece 150, external air may get into the atomizing assembly 120 through the first inlet airway 164 and the second inlet airway 165, then outputted to the user's mouth through the central airway 141 and the air suction port 151.

Figure 4:
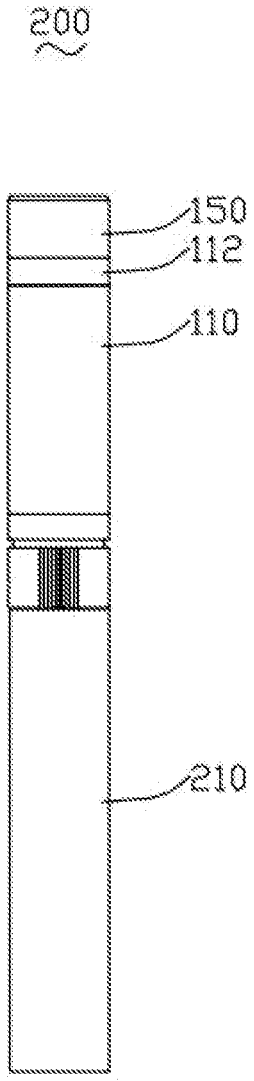
FIG. 4 is a perspective view of an electronic cigarette incorporating the atomizer according to an embodiment of the present disclosure.

Referring to FIG. 4, the present disclosure further discloses an electronic cigarette 200, the electronic cigarette includes a battery module 210 and the aforementioned atomizer 100. The battery module 210 is connected with the base 160 of the atomizer 100 to supply power to the heating element 123 of the atomizing assembly 120 for atomization.

A person having ordinary skill in the art can understand easily, the electronic cigarette 200 and atomizer 100 thereof have the blocking component 130 thereon that is capable of blocking rapid flowing of the tobacco liquid when the reservoir 110 is laid flat or tilted with a tail upwards, ensuring the tobacco liquid to be kept around the atomizing assembly 120, and hence avoiding few tobacco liquid existing in the atomizing assembly 120 because of rapid flowing of the tobacco liquid such that the electronic cigarette 200 may generate burnt flavor when smoked.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a reservoir, the reservoir being configured for storing tobacco liquid;

an atomizing assembly, the atomizing assembly being disposed inside the reservoir, at a lower end of the reservoir, and configured to absorb tobacco liquid for atomization; and a blocking component, the blocking component being disposed in the reservoir, and configured for blocking tobacco liquid in the reservoir when tobacco liquid flows from the lower end of the reservoir toward an upper end thereof, such that tobacco liquid is kept around the atomizing assembly; the atomizing assembly comprises an atomizing sleeve, a liquid conducting component and a heating element; the atomizing sleeve has a liquid conducting hole formed thereon; the liquid conducting component is disposed inside the atomizing sleeve to absorb tobacco liquid by means of the liquid hole; the heating element is disposed inside the liquid conducting component to heat and atomize tobacco liquid absorbed by the liquid conducting component.

2. The atomizer according to claim 1, wherein the atomizer further comprises a gas tube and a mouthpiece; the mouthpiece is disposed at the upper end of the reservoir; the gas tube is configured for communicating the atomizing assembly and the mouthpiece; the blocking component comprises a blocking ring fixed on the gas tube; an outer surface of the blocking ring abuts against an inner surface of the reservoir.

3. The atomizer according to claim 2, wherein the blocking ring is fixed on a joint of the gas tube and the atomizing assembly; a vent disposed on the blocking ring is configured for communicating the gas tube and the atomizing assembly.

4. The atomizer according to claim 3, wherein the blocking component further comprises a first insert tube and a second insert tube at two sides of the blocking ring; the first insert tube is inserted into a lower end of the gas tube for fixing and the second insert tube is inserted into an upper end of the atomizing assembly for fixing; the vent is also configured to be in communication with the first insert tube and the second insert tube.

5. The atomizer according to claim 4, wherein the blocking ring further has a hole formed thereon, configured for allowing tobacco liquid passing through the hole to flow in the reservoir.

6. The atomizer according to claim 5, wherein the hole is a cutout hole formed on edge of the blocking ring.

7. An electronic cigarette, comprising a battery module and an atomizer, wherein the atomizer comprises:

a reservoir, the reservoir being configured for storing tobacco liquid;

an atomizing assembly, the atomizing assembly being disposed inside the reservoir, at a lower end of the reservoir, and configured to absorb tobacco liquid for atomization; and a blocking component, the blocking component being disposed in the reservoir, and configured for blocking tobacco liquid in the reservoir when tobacco liquid flows toward an upper end of the reservoir, such that tobacco liquid is kept around the atomizing assembly; the atomizing assembly comprises an atomizing sleeve, a liquid conducting component and a heating element; the atomizing sleeve has a liquid conducting hole formed thereon; the liquid conducting component is disposed inside the atomizing sleeve to absorb tobacco liquid by means of the liquid hole; the heating element is disposed inside the liquid conducting component to heat and atomize tobacco liquid absorbed by the liquid conducting component.

8. The atomizer according to claim 1, wherein the atomizer further comprises a base connected with the lower end of the reservoir, the base being configured for connecting a battery module to supply power to the heating element;

wherein the base comprises a cathode base, an insulating bush and anode rods; the anode rods are interval inserted into the cathode base through the insulating bush, insulated from the cathode base; two pins of the heating element are respectively in contact with the cathode base and the anode rods to form a conductance.

9. The atomizer according to claim 8, wherein the cathode base and the atomizing sleeve are formed integrally or are two separate structures; the cathode base has a threaded jointer convexly disposed thereon; the threaded jointer is configured for connecting the battery module; the cathode base has a first inlet airway formed thereon and the anode rods has a second inlet airway formed thereon.

10. The atomizer according to claim 2, wherein the blocking ring is disposed on the gas tube.

11. The electronic cigarette according to claim 7, wherein the atomizer further comprises a base connected with the lower end of the reservoir, the base being configured for connecting a battery module to supply power to the heating element;

wherein the base comprises a cathode base, an insulating bush and anode rods; the anode rods are interval inserted into the cathode base through the insulating bush, insulated from the cathode base; two pins of the heating element are respectively in contact with the cathode base and the anode rods to form a conductance.

12. The electronic cigarette according to claim 7, wherein the atomizer further comprises a gas tube and a mouthpiece; the mouthpiece is disposed at the upper end of the reservoir; the gas tube is configured for communicating the atomizing assembly and the mouthpiece; the blocking component comprises a blocking ring fixed on the gas tube; an outer surface of the blocking ring abuts against an inner surface of the reservoir.

13. The electronic cigarette according to claim 12, wherein the blocking ring is fixed on a joint of the gas tube and the atomizing assembly; a vent disposed on the blocking ring is configured for communicating the gas tube and the atomizing assembly.

14. The electronic cigarette according to claim 13, wherein the blocking component further comprises a first insert tube and a second insert tube at two sides of the blocking ring; the first insert tube is inserted into a lower end of the gas tube for fixing and the second insert tube is inserted into an upper end of the atomizing assembly for fixing; the vent is also configured to be in communication with the first insert tube and the second insert tube.

15. The electronic cigarette according to claim 14, wherein the blocking ring further has a hole formed thereon, configured for allowing tobacco liquid passing through the hole to flow in the reservoir.

16. The electronic cigarette according to claim 15, wherein the hole is a cutout hole formed on edge of the blocking ring.

17. The electronic cigarette according to claim 12, wherein the blocking ring is disposed on the gas tube.

18. The electronic cigarette according to claim 11, wherein the cathode base and the atomizing sleeve are formed integrally or are two separate structures; the cathode base has a threaded jointer convexly disposed thereon; the threaded jointer is configured for connecting the battery module; the cathode base has a first inlet airway formed thereon and the anode rods has a second inlet airway formed thereon.

* * * * *